US010072849B2

(12) United States Patent
Kim et al.

(10) Patent No.: US 10,072,849 B2
(45) Date of Patent: Sep. 11, 2018

(54) COOKING TOP

(71) Applicant: LG ELECTRONICS INC., Seoul (KR)

(72) Inventors: Myungsang Kim, Seoul (KR); Jonggwan Ryu, Seoul (KR); Kwangyong Kim, Seoul (KR); Youngmin Lee, Seoul (KR); Minhye Park, Seoul (KR); Jeongwon Seo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 5 days.

(21) Appl. No.: 15/435,615

(22) Filed: Feb. 17, 2017

(65) Prior Publication Data

US 2017/0363299 A1 Dec. 21, 2017

(30) Foreign Application Priority Data

Jun. 15, 2016 (KR) ..... 10-2016-0074598

(51) Int. Cl.

| | |
|---|---|
| ***F24C 15/00*** | (2006.01) |
| ***F24C 15/20*** | (2006.01) |
| ***F24C 3/02*** | (2006.01) |
| ***F24C 7/04*** | (2006.01) |
| ***H05B 3/68*** | (2006.01) |
| ***F24C 15/10*** | (2006.01) |

(52) U.S. Cl.

CPC ..... *F24C 15/2028* (2013.01); *F24C 3/027* (2013.01); *F24C 7/046* (2013.01); *F24C 15/10* (2013.01); *H05B 3/68* (2013.01)

(58) Field of Classification Search

CPC ..... F24C 15/00

USPC ..... 126/299 D

See application file for complete search history.

(56) References Cited

U.S. PATENT DOCUMENTS 4,983,799 A * 1/1991 Bonnet ..... F24C 7/083 126/21 A

2010/0051010 A1 3/2010 Colburn et al.

FOREIGN PATENT DOCUMENTS

| | | |
|---|---|---|
| CN | 10-2538032 | 7/2012 |
| CN | 102589027 | 7/2012 |
| CN | 204026779 | 12/2014 |

(Continued)

OTHER PUBLICATIONS

European Search Report dated Aug. 4, 2017 issued in Application No. 17150748.6.

(Continued)

*Primary Examiner* — Avinash Savani

(74) *Attorney, Agent, or Firm* — Ked & Associates, LLP

(57) ABSTRACT

Provided is a cooking top including a main body including a heating unit, and an air curtain device that generates an air curtain flow that blocks diffusion of air flow generated by the heating unit. The air curtain device may include an intake port formed at the main body, an exhaust port that extends laterally along an upper portion of the main body, a flow guide that extends from the intake port to the exhaust port, a drive unit installed inside the flow guide to generate airflow, and an airflow control device rotatably mounted at the main body to open and close the exhaust port and configured to operate the drive unit when the airflow control device is rotated to open the exhaust port so as to generate the air curtain flow.

19 Claims, 3 Drawing Sheets

(56) References Cited

FOREIGN PATENT DOCUMENTS

| | | |
|---|---|---|
| JP | 2003-144250 | 5/2003 |
| KR | 20-1985-000036 | 3/1985 |
| WO | WO 2004/090425 | 10/2004 |

OTHER PUBLICATIONS

Korean Office Action dated Nov. 28, 2017 issued in Application No. 10-2016-0074598.
Korean Notice of Allowance dated May 29, 2018 issued in Application No. 10-2016-0074598.

* cited by examiner

COOKING TOP

CROSS-REFERENCE TO RELATED APPLICATION(S)

Pursuant to 35 U.S.C. § 119(a), this application claims the benefit of earlier filing date and right of priority to Korean Application No. 10-2016-0074598, filed on Jun. 15, 2016, the contents of which is incorporated by reference herein in its entirety.

BACKGROUND

1. Field

Provided is a cooking top having an air curtain device.

2. Background

Cooking tops having air curtain devices are known. However, they suffer from various disadvantages.

BRIEF DESCRIPTION OF THE DRAWINGS

The embodiments will be described in detail with reference to the following drawings in which like reference numerals refer to like elements wherein.

DETAILED DESCRIPTION

Figure 1:
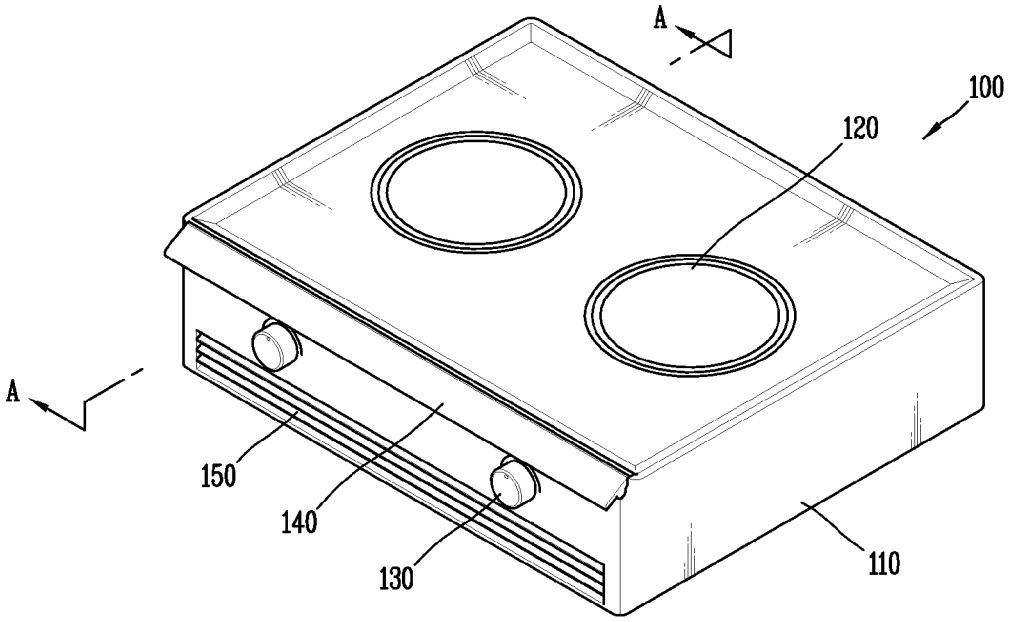
FIG. 1 is a perspective view of a cooking top according to an embodiment of the present disclosure.

Hereinafter, a cooking top according to the present disclosure will be described in detail with reference to the accompanying drawings. In describing exemplary embodiments disclosed in this specification, a specific description for publicly known technologies to which the disclosure pertains will be omitted when the description is judged to obscure the gist of the embodiments disclosed in the specification.

Also, it should be understood that the accompanying drawings are merely illustrated to easily explain exemplary embodiments disclosed in this specification, and therefore, they should not be construed to limit the technical idea disclosed in this specification but be construed to cover all modifications and alternatives falling within the spirit and scope of the present disclosure. Moreover, singular expressions include plural expressions unless the context clearly dictates otherwise.

Generally, a cooking top (or cooktop) is an apparatus that is formed in a base shape with a built-in heating means therein and is used to cook food by heating a cooking container placed on a top surface.

The cooking top may be classified as a gas cooking top or an electric cooking top depending on the heating means. The gas cooking top is operated using gas. When the gas cooking top is used in everyday life, it may be configured only with a gas cooking top (e.g., a gas range) or configured together with an oven for cooking food using high-temperature heat in an enclosed space.

The electric cooking top is operated by using heat generated by an electric energy source and by conduction, convection, or radiant heat transfer thereof. Like the gas cooking top, the electric cooking top may be configured to be a stand-alone device or integrated with an oven. The electric cooking top is advantageous in that there is no harmful gas or soot due to gas combustion and there is no worry of deficiency or generation of carbon monoxide. In addition, there are fewer safety accidents and fire hazards, and there is an advantage of its simple appearance and ease in cleaning. Therefore, the demand for electric cooking top is increasing.

On the other hand, an exhaust system such as a hood may be installed at an upper part of the cooking top in order to remove smoke, odor, fine dust, or the like, generated from food in the case of the electric cooking top or combustion gas during cooking in the case of the gas cooking top.

In addition to this, there is also a technique for isolating the air above the cooking top by forming an air curtain. An air curtain is a barrier formed by airflow which is a layer of air that flows vertically, while laterally surrounding the upper part of the cooking top. Particularly, in the case of a conventionally-used gas cooking top (e.g., a gas range), the harmfulness of the combustion gas is a problem. Therefore, there has been continuous improvements and developments in techniques for forming and driving the air curtain. However, these techniques to form an air curtain may have various limitations and disadvantages as described below.

First, there may not be an effective way to operate the air curtain, for example, to turn on or off at anytime by the user. It is often necessary to carry out operations such as transferring or cooking food in a container placed at a gas cooking top while cooking top (and the heat source) is in operation, and thus there is a need to selectively operate the air curtain. To this end, a structure capable of turning on/off the air curtain flow by a simple operation in a short amount of time is desirable.

In addition, there is a possibility that foreign matter may enter a portion of the cooking top where air is discharged for forming the air curtain. For example, if there is an outlet which is opened upwardly to form an air curtain flow towards the top, foreign matter, such as food, may enter the outlet. In order to solve this problem, a structure with a cover or a wall may be provided near the outlet. However, such cover or wall may interfere with the flow passage for the air curtain, and additionally, may not have a configuration for completely closing the exhaust port when necessary.

On the other hand, if the outlet where an air curtain flow is formed is disposed higher than a heating unit in order to lower the possibility that foreign matter such as food or the like is introduced, there is a disadvantage that it may be more difficult to visually check the state of the heating unit. Particularly, in the case of an electric cooking top, it is possible that a cooking container closely contacts and covers the heating unit, obscuring the heating unit. Thus, in this case, it is more difficult to visually check the state of the heating unit.

Cooking tops suffer from these and other disadvantages. A cooking top that addresses these and other disadvantages is disclosed hereinafter.

The cooking top of the present disclosure may be a plate type in which heat is generated by using a chemical (combustion gas) or an electric energy source, and may be configured for placing thereon a cooking container such as a pot containing food, or the like, to cook food by heating. The cooking top may be provided in a home or a commercial facility as a stand-alone appliance or may be a part of an appliance configured together with an oven that forms an airtight space and cooks food through internal heating.

FIG. 1 is a perspective view of a cooking top 100 according to an embodiment of the present disclosure. The cooking top 100 may be configured to prevent the spread of harmful particles such as smoke, odor, or fine dust generated during cooking, and may include an air curtain device. Hereinafter, the appearance and each component will be described, and specifically, the structure and function of components constituting the air curtain device will be described in detail.

The cooking top 100 may include a main body 110, a heating unit 120, and an interface unit externally. The main body 110 forms the appearance of the cooking top 100, and the heating unit 120 may be provided at the upper part.

The heating unit 120 is configured to heat a cooking container, or the like, placed on the surface of the heating unit 120 through a general combustion gas or an electric energy source as described above. In this embodiment as illustrated in FIG. 1, a heater using electricity is disclosed as being used for the heating unit 120, but the present disclosure is not limited thereto.

The heating unit 120 may be formed in a circular shape when viewed from the upper side of the main body 110. However, the heating unit 120 may be located in a space that is recessed from the upper part of the main body 110 toward the inside and such a feature will be described later.

On the other hand, particles such as harmful gas, smoke, odor or fine dust due to combustion from cooking food may be generated at the upper part of the heating unit 120 and may contaminate the air. In addition, even if there is no separate driving force, as a natural convection phenomenon occurs due to the heat generated by the heating unit 120, a heating unit air flow 10 (see FIG. 2B) is generated and spreads to the surroundings. The cooking top 100 is intended to block such air flow 10 from diffusing.

The interface unit for manipulating whether to operate the heating unit 120, the intensity of heat, and the like, may be positioned at the front end of the main body 110 so that the user may easily manipulate the interface unit. In this embodiment, an interface unit is provided at a front surface part formed vertically at the front end of the main body 110.

However, the interface unit may be provided at the upper surface of the main body 110 if necessary. In addition, the front surface part of the main body 110 may not necessarily be vertical, and may have a form provided at an inclined surface for allowing a user to more easily see the interface unit or to manipulate controls by hand.

In relation to the cooking top 100, the interface unit may include a knob 130 or another appropriate type of control interface for adjusting the heating intensity of the heating unit 120. The knob 130 may be operated by rotation. In the case of a gas cooking top, it may be determined whether or not to discharge the combustion gas to the heating unit 120 by mechanical operations, and additionally, the flow rate of the combustion gas may be adjusted. An electric cooking top according to this embodiment may be configured to vary the electric power supply amount, or the like, through an electric circuit according to the rotation of the knob 130. The form of the knob 130 may have a cylindrical shape which protrudes from the front surface part of the main body 110.

Moreover, the cooking top 100 may further include an operation unit 140 and an intake grill 150 provided externally, as shown in FIG. 1. The operation unit 140 serves to drive or adjust an air curtain flow 20 (see FIG. 2B) of the cooking top 100 as desired by the user. Additionally, when the air curtain function is not used, the operation unit 140 may serve as a lid or cover to protect the air curtain device, for example, to prevent spills or other items from falling inside the main body 110. The operation unit 140 may also be referred to herein as an airflow control device.

The intake grill 150 serves to suction air and allow it to flow into an intake port 110*a* so that the air curtain flow 20 may be formed at the cooking top 100. The detailed configuration and effect of the operation unit 140 and the intake grill 150 will be described below together with the components provided inside the main body 110.

Figure 2A:
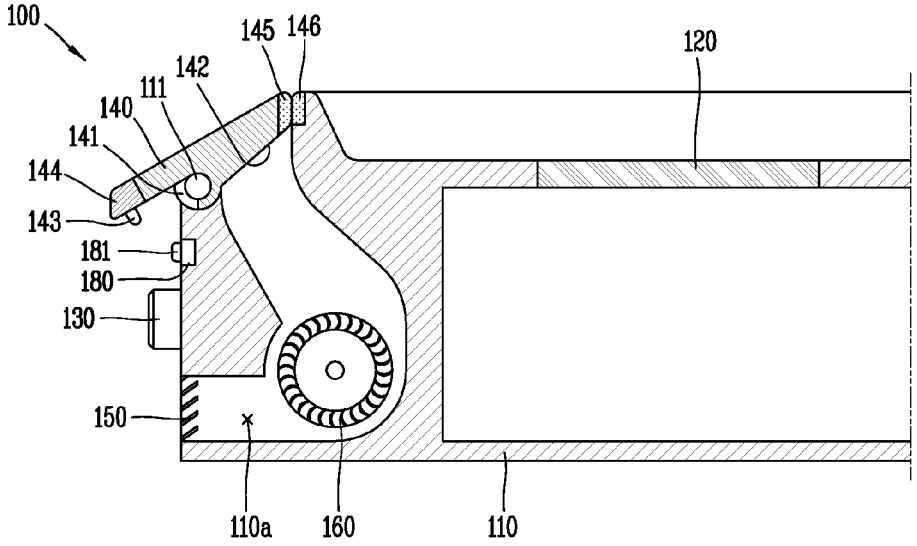
FIG. 2A is a cross-sectional view taken along line AA' in FIG. 1.
Figure 2B:
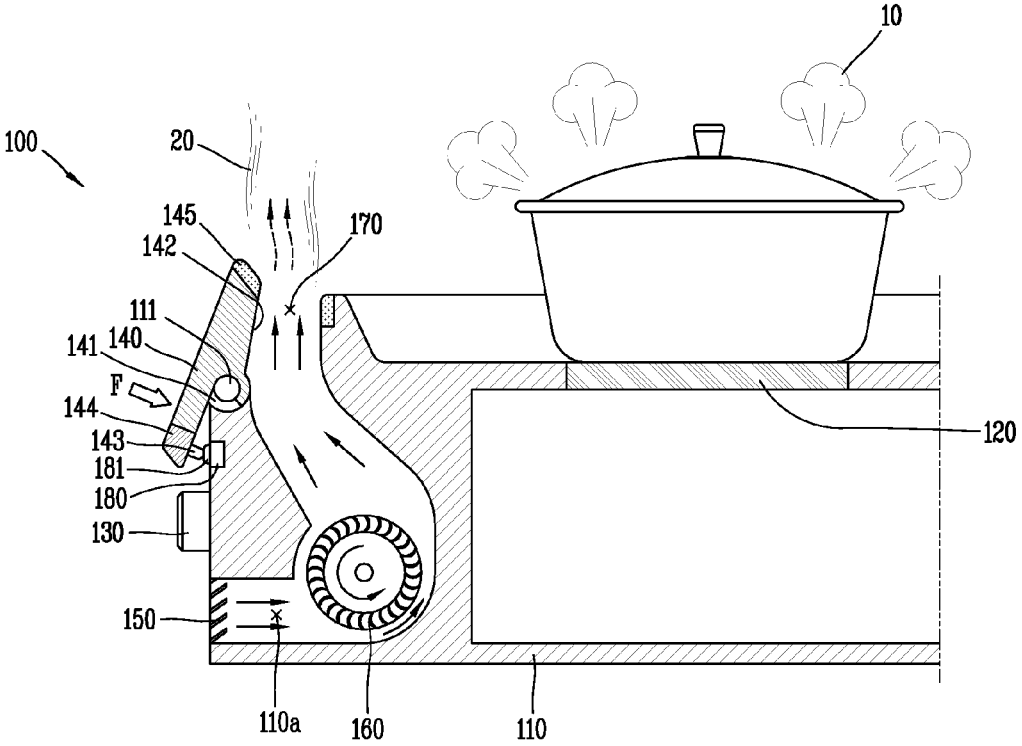
FIG. 2B is a cross-sectional view taken along line AA' in FIG. 1 during operation of an air curtain device of a cooking top according to an embodiment of the present disclosure.

FIG. 2A is a sectional diagram taken along line AA' in FIG. 1 and FIG. 2B is a sectional diagram taken along line AA' in FIG. 1 during operation of an air curtain device of a cooking top. With reference to FIG. 1 and FIGS. 2A and 2B together, components constituting an air curtain device for implementing the air curtain flow 20 of the cooking top 100 will be described in detail.

Referring to FIGS. 2A and 2B, the air curtain device of the cooking top 100 may include a drive unit 160 and an exhaust port 170 together with the operation unit 140 and the intake grill 150 as described above. The air curtain device draws in air to flow through the intake grill 150 and the intake port 110*a*, accelerates the air in a prescribed direction in the drive unit 160, and allows the air to flow out through the exhaust port 170 to form the air curtain flow 20. The operation unit 140 functions to control operation of the air curtain flow 20 by user's operation.

Below, the operation unit 140 for adjusting the air curtain flow 20 will be described after describing the components in the order of the air flow formed when the air curtain flow 20 is operated.

When the air curtain flow 20 is generated, air flows into the main body 110 through the intake port 110*a*. The intake port 110*a* serves to supply air so that the air curtain flow 20 is continuously generated from the main body 110. The intake port 110*a* may have a shape in which the outside of the main body 110 communicates with the inside thereof. In this embodiment, the intake grill 150 is installed at the path where air flows to the intake port 110*a* to prevent objects such as human hands, foreign substances, etc., from entering inside of the main body 110.

On the other hand, the intake port 110*a* is disclosed as being provided at the front surface part of the main body 110 in this embodiment. This is for suctioning air from a space that is separate from the heating unit air flow 10, e.g., the top or cooking surface of the cooking top 100. A space where the heating unit air flow 10 would not be suctioned through the intake port 110*a* may exist in another space other than the front surface part of the main body 110. The intake port 110*a* and the intake grill 150 may be disposed in another appropriate location so as to suction air from such a space other than the front surface part.

The air flow introduced and formed at the intake port 110*a* is converted to the air curtain flow 20 by the drive unit 160. That is, the drive unit 160 functions to guide the air flow in a predetermined direction and to accelerate the air flow to form the air curtain flow 20.

For this, in this embodiment, the drive unit 160 may include a cross flow fan. The cross flow fan is provided with a motor at one side for outputting a mechanical rotational force by using an electric energy source, and has a long shape extending lengthwise along the rotation shaft. A blade is installed along the circumferential direction so as to generate the flow in a circumferential direction according to the rotation of the motor. The area of a certain angle along the circumferential direction may be divided as a side where air is suctioned and the area of another constant angle may be divided as a side where air is outputted.

When the drive unit 160 includes a cross flow fan as in the this embodiment, there is an advantage that it is easy to output the thin and long air curtain flow 20 corresponding to the form of an exhaust port 170 described later.

The drive unit 160 may be installed inside the main body 110. As shown in FIGS. 2A and 2B, the cross flow fan of this embodiment may be located to form a side where air flows in a direction facing the intake grill 150 and a side where accelerated air is outputted in the upward direction of the main body 110. Especially, the air curtain flow 20 at the lower end of the exhaust port 170 may be generated and directly delivered to the exhaust port 170. Moreover, the air curtain flow 20 may have a form that extends lengthwise in the rotation shaft direction by the length of the exhaust port 170.

On the other hand, in order to prevent the noise of the drive unit 160 from being transmitted to the outside, in consideration of the limited space in the cooking top 100, the intake port 110*a*, and the intake grill 150 at the front surface part of the main body 110, the drive unit 160 may be located within the main body 110 to be away from the front surface part of the main body 110.

In addition, the drive unit 160 does not necessarily have to be a cross flow fan, but may include various driving means for discharging air at a constant speed and flow rate. Specifically, when the cross flow fan is used as in the embodiment of FIG. 1, there is an advantage that noise is small, but there is a disadvantage in that the output volume may be relatively weaker. Therefore, a power source including a motor used for a vacuum cleaner, or the like, may be mounted inside the main body so as to minimize noise, and the space utilization may be increased by increasing the volume.

However, if the generated flow is different from the desired form/shape of the air curtain flow 20 or is positioned further away from the position where the air curtain flow 20 is to be formed, a flow guide for transferring the air to the exhaust port 170 may be provided in order to guide air and generate the thin and long form of the air curtain flow 20.

The air curtain flow 20 generated through the intake port 110*a* and the drive unit 160 and accelerated in one direction is formed to flow out of the main body 110 through the exhaust port 170. The exhaust port 170 may be a space through which the air curtain flow 20 is output from the main body 110 and may serve to determine the position and form of the air curtain flow 20.

The form of the exhaust port 170 may be provided to communicate between the inside and outside of the main body 110 in a form that extends lengthwise in one direction to match the form of the thin and long air curtain flow 20 desired for blocking the heating unit air flow 10. In addition, the exhaust port 170 may be installed at a position opened toward the upper part of the main body 110. This is because the heating unit air flow 10 where convection occurs is formed in the upper part of the main body 110.

In this embodiment, the exhaust port 170 is formed extending to be opened toward the upper part along the edge part where the front surface part and the upper surface meet. In relation to the cooking top 100, a space where a user is mainly located becomes the front part of the main body 110 where the knob 130 for operating the heating unit 120 is disposed, so that it may be configured to prevent the heating unit air flow 10 from diffusing to the front part of the main body 110. In addition, the exhaust port 170 may be formed along the edge part where the upper surface of the main body 110 and the side part or the rear part of the main body 110 meet.

The operation of the air curtain flow 20 described above is performed under the assumption that the exhaust port 170 is open. The operation unit 140 that adjusts the air curtain flow 20 and performs a cover function of the exhaust port 170 will be described below.

As detailed in FIGS. 2A and 2B, the cooking top 100 further includes the operation unit 140 provided in the main body 110. First, the operation unit 140 is formed to cover the exhaust port 170 in order to prevent foreign matter from entering the exhaust port 170. In this embodiment, the operation unit 140 may extend long (e.g. lengthwise) to cover the exhaust port 170 formed at the edge part of the main body 110. The operation unit 140 may be coupled to the main body 110 in an inclined form extending from the front part of the main body 110 to the upper surface of the main body 110.

The coupling of the operation unit 140 and the main body 110 is accomplished to allow the operation unit 140 to open/close the exhaust port 170. The cooking top 100 may be provided to allow the exhaust port 170 to be opened while the air curtain flow 20 is formed and the operation unit 140 may be positioned to be out of the flow passage of the air curtain flow 20.

In order to couple the operation unit 140, the main body 110 may include a connection pin 111. The connection pin 111 may extend parallel to the extension formation direction of the operation unit 140 to be fixed to the main body 110. That is, since the operation unit 140 extends laterally along the edge part where the front part and the upper surface of the main body 110 meet, the connection pin 111 may also extend laterally parallel to the operation unit 140.

The connection pin 111 may be formed to be fixed to the side surface of the main body 110, and may be formed to laterally cross the lower end of the exhaust port 170. However, the connection pin 111 does not necessarily have to extend the entire length of the exhaust port 170, but may have a length sufficient to support the operation unit 140 and implement a rotating operation.

Moreover, the operation unit 140 may include a hinge part 141 that is rotatably fastened to the connection pin 111 of the main body 110. The hinge part 141 may be positioned at the center of the back surface of the operation unit 140 so that the exhaust port 170 may be opened and closed with ease in the cooking top 100. That is, as illustrated in FIGS. 2A and 2B, the operation unit 140 may rotate based on the hinge part 141, so that each of the upper part and the lower part of the operation unit 140 may be moved to draw a constant rotation radius.

By such a coupling relationship, as shown in FIG. 2B, the exhaust port 170 may be opened by an external force F to push the lower part of the operation unit 140. In addition, the exhaust port 170 may be closed by a force to push the upper part of the operation unit 140. That is, both the opening and closing of the exhaust port 170 and the generation and termination operations of the air curtain flow 20, which are accomplished according to the following description, may be realized by pushing the operation unit 140. Therefore, the cooking top 100 may provide the effect that the air curtain flow 20 is adjusted easily and intuitively while a cooking operation is continued, and the utilization of the air curtain flow 20 is further improved.

The operation unit 140 of the cooking top 100 may further include a guide part 142 and a stopper part 143. The guide part 142 may serve to form the air curtain flow 20 and also serve to stably form the air curtain flow 20 together with the stopper part 143.

As shown in FIGS. 2A and 2B, the guide part 142 may be formed at the upper end of the hinge part 141 in the back surface of the operation unit 140. The guide part 142 may be located at the boundary where the air curtain flow 20 passes when the operation unit 140 is positioned so the exhaust port 170 is opened. The guide part 142 may be formed in a streamlined manner that allows the air curtain flow 20 driven by the drive unit 160 to flow smoothly, so that it functions to form a shape of the air curtain flow 20 exiting the main body 110 together with the exhaust port 170.

On the other hand, as shown in FIGS. 2A and 2B, the stopper part 143 may be formed on the operation unit 140, opposite the guide part 142 relative to the hinge part 141. That is, the stopper part 143 may be positioned blow the hinge part 141 at the bottom surface of the operation unit 140. The stopper part 143 may protrude from the back surface of the operation unit 140 so that it is supported in contact with the main body 110 when the operation unit 140 is positioned to open the exhaust port 170.

When the air curtain flow 20 starts to be driven by the drive unit 160 with the exhaust port 170 opened, since air is continuously discharged through the exhaust port 170, the operation unit 140 may receive a force by the air curtain flow 20 in the direction of opening the exhaust port 170. This results in a force to rotate the operation unit 140 counterclockwise with respect to the hinge part 141 shown in FIGS. 2A and 2B.

At this point, the stopper part 143 may serve to support the operation unit 140 in a clockwise direction. The height (or length) of the stopper part 143 may be set in consideration of the angle formed by the guide part 142 when the exhaust port 170 is opened by the rotation of the operation unit 140.

Accordingly, as the force due to the support of the stopper part 143 and the force due to the air curtain flow 20 are balanced, the operation unit 140 and the guide part 142 formed at the back surface of the operation unit 140 may be fixed in position while the air curtain flow 20 is formed. Thereby, the form of the air flow and the flow passage may be stably maintained while the air curtain flow 20 is generated.

Additionally, the relationship between the load supporting the operation unit 140 and the weight of the operation unit 140 when the air curtain flow 20 contacts the guide part 142 may be set appropriately by forming a mass body part 144 at the operation unit 140.

In this embodiment, the mass body part 144 may be formed at the left lower end of the operation unit 140 relative to the hinge part 141 shown in FIGS. 2A and 2B. The mass body part 144 formed at such a position may serve to apply a force in the counterclockwise direction by using the hinge part 141 as an axis. This direction is the same as the direction for rotating the operation unit 140 with the force of the air curtain flow 20. If the force of the air curtain flow 20 is not strong enough to push the weight of the operation unit 140, the mass body part 144 formed at this position may allow a stable open state of the exhaust port 170 to be maintained.

On the other hand, when the force of the air curtain flow 20 to push the operation unit 140 is very strong, if may be possible that damage to the stopper part 143 or the main body 110 is possible by the resulting impact. In this case, the mass body part 144 may be located at a side where the guide part 142 is formed at the back surface. Here, the weight of the mass body part 144 may act in a direction opposite to the force of the air curtain flow 20, counteracting the force of the air curtain flow 20. Hence, it is possible to achieve a smooth rotation operation of the operation unit 140 by adjusting the mass and position of the mass body part 144.

Furthermore, the stopper part 143 may be formed such that a protrusion height may be adjustable. When the projection height of the stopper part 143 is adjusted, an angle at which the guide part 142 is fixed may be varied. By such an angle variation, in general, a portion of the flow exiting through an exhaust port or a hood device separately disposed at the upper side to face a cooking top may be adjusted to merge with the air curtain flow 20. Through this, the air curtain flow 20 may guide the heating unit air flow 10 to flow into an exhaust port or a hood device so that the air curtain flow 20 may further effectively block the heating unit air flow 10, which is the purpose of the air curtain flow 20.

The operation unit 140 of the cooking top 100 may further include a sealing part 145 so as to effectively close the exhaust port 170 in the state shown in FIG. 2A. The sealing part 145 may prevent food or other foreign matters from entering the exhaust port 170 which may, for example, damage or interrupt an operation of the air curtain device or cause smells or decay from occurring inside the device.

The sealing part 145 may be made of a magnetic material and may serve to completely close the exhaust port 170. As shown in FIGS. 2A and 2B, one or both of the sealing part 145 and a portion 146 of the main body 110 which it contacts may be made of a magnetic material having a pulling force and the contact surface may be formed to completely close the exhaust port 170.

The amount of attractive force between the sealing part 145 and the portion 146 of the main body 110 contacting the sealing part 145 may be set in consideration of the force due to the position and mass of the mass body part 144. For example, when the operation unit 140 is positioned with the exhaust port 170 closed, the operation unit 140 may be installed to have an attracting force greater than a rotating force in a direction for opening the exhaust port 170 due to the weight of the mass body part 144 or the operation unit 140 itself.

In addition, when the attracting force is set too large, although the sealing effect is not a problem, since the external force required to open the exhaust port 170 by rotating the operation unit 140 may become too large, it may cause inconvenience in use. Hence, the attractive force may be set so that the operation of the operation unit 140 is not inconvenient.

The operation unit 140 mounted on the cooking top 100 may have a function for turning on/off the operation of the drive unit 160 in addition to the above-described functions for opening the exhaust port 170 and molding a shape of the air curtain flow 20. Hereinafter, a configuration of the operation unit 140 to control the operation of the drive unit 160 will be described in detail.

The main body 110 of the cooking top 100 according to the present disclosure may further include a drive control unit 180, and the drive control unit 180 may include a switch 181. The switch 181 may be an optical switch or a push switch 181. The drive control unit 180 may be a device for controlling the operation of the drive unit 160. The optical switch or push switch 181 may serve to detect the open state of the exhaust port 170 according to a movement of the operation unit 140.

The drive control unit 180 may be installed inside the main body 110 and may be configured to transmit an operation/non-operation signal to the drive unit 160 that drives the air curtain flow 20. The drive control unit 180 may be configured to transmit signals in correspondence to the open/closed state of the exhaust port 170 and may include an optical switch or a push switch 181 that detects the open/closed state of the exhaust port 170.

The optical switch may include an optical sensor that detects a change in illuminance of light formed on a detection surface, and may be configured to transmit a signal when an illuminance of more than a predetermined value is detected. The optical sensor may be mounted inside the exhaust port 170 so that the variation of the illuminance appears to be greater than the exhaust port 170 is opened.

On the other hand, as shown in FIGS. 2A and 2B, the push switch 181 may be positioned so as to be pressed by the movement of the operation unit 140. Specifically, the operation unit 140 may be positioned to open the exhaust port 170 and the back surface of the operation unit 140, which rotates at the left lower end of the hinge part 141 with reference to FIGS. 2A and 2B, may be configured to press the push switch 181. Here, since the stopper part 143 contacts the front part of the main body 110, the push switch 181 may be provided at the position corresponding to the stopper part 143 so that the accuracy of the pressing operation may be obtained. It should be appreciated that both the optical switch and the push switch may be used.

As the optical switch or push switch 181 is provided, it is possible to control the operation of the drive unit 160 to start and stop together with implementing the opening and closing of the exhaust port 170 based on rotation of the operation unit 140. When a user operates the operation unit 140 to open the exhaust port 170, since the drive unit 160 that generates the air curtain flow 20 may be operated at the same time to form the air curtain flow 20, the operation of the air curtain device may be easily realized.

Figure 3:
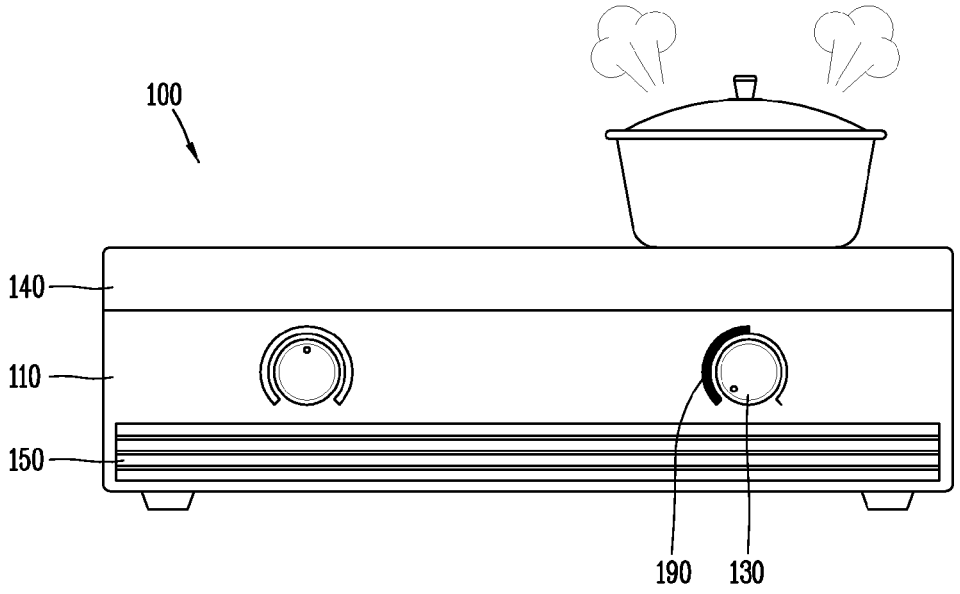
FIG. 3 is a front view of a cooking top shown in FIG. 1 according to an embodiment of the present disclosure.

Moreover, the interface unit of the cooking top 100 may further include a display 190. The display 190 may perform a function for easily checking the state of the heating unit 120. FIG. 3 is a front view illustrating a state in which the display 190 of the cooking top 100 operates according to the present disclosure. Referring to FIG. 3, the structure and function of the display 190 will be described below.

As described above, the present disclosure is provided with an air curtain device including the operation unit 140. The operation unit 140 may be positioned at the edge part between the front part and the upper surface of the main body 110, so that it is provided as an operation means of an air curtain function. However, when rotated to open the exhaust port 170, the operation unit 140 may be positioned so as to protrude from the upper surface of the main body 110. Therefore, there is a possibility that the view of the heating unit 120 is obscured and may not easily be checked visually by the user, e.g., to verify an on/off state or a heat intensity of the heating unit 120.

On the other hand, the upper surface where the heating unit 120 is positioned may be formed lower than the upper surface where the exhaust port 170 is located in order to prevent the contamination of the exhaust port 170, for example, due to liquid on the upper surface of the heating unit 120 or the main body 110 from overflow from a cooking container. That is, the cooking top 100 may be configured such that the upper surface of the main body 110 is recessed downward and the heating unit 120 is positioned at the recessed position. This performs a function similar to a function for installing a fixed wall or cover to protect the exhaust port 170. However, as in the case due to the operation of the operation unit 140 by such features, there is a possibility that the view of the heating unit 120 may be obscured and it may be more difficult for the user to visually check the heating unit 120.

In order to solve the difficulty in checking the state of the heating unit 120, the display 190 for indicating the state of the heating unit 120 may be installed at the interface unit. A circular display 190 may be mounted around a knob 130 at the front part of the main body 110. The display 190 may indicate that the heating unit 120 is in operation when the heating unit 120 is operating and generating heat. Furthermore, the display 190 may be configured to change the displayed area according to the heating intensity of the heating unit 120. More specifically, when the knob 130 is rotated to increase the heat calorie of the heating unit 120, it is possible that a width displayed in the circumferential direction is increased according to the rotation of the knob 130.

By displaying whether the heating unit 120 is operational as well as indications for heat intensity on the front part of the main body 110 through the display 190, a user may promptly recognize the state of the heating unit 120. Particularly, even when the operation unit 140 is mounted on the front end of the main body 110 or when the heating unit 120 is positioned in a recess on the upper surface of the main body 110, a user may easily check visually whether the heating unit 120 is operating as well as the heat intensity.

A cooking top according to the present disclosure has been described herein to address various disadvantages and deficiencies. The first purpose of the detailed description is to provide a cooking top configured to open/close an exhaust port through which an air curtain flow is discharged and to easily adjust the opening/closing of the exhaust port and an operation of a drive unit while generating the air curtain flow to block the diffusion of air generated during cooking.

The second purpose of the detailed description is to provide a cooking top configured to link opening and driving operations to each other so as to operate an air curtain flow together with an operation of opening an exhaust port when an operation unit for covering the exhaust port is provided.

The third purpose of the detailed description is to provide a cooking top configured to stably form an air curtain flow toward an upper part of a main body and allow an angle at which the air curtain flow is formed to be maintained when opening an exhaust port by operating an operation unit and generating the air curtain flow.

The fourth purpose of the detailed description is to provide a cooking top configured to prevent foreign matter such as liquid or particles occurring during cooking from entering the inside of an air curtain device as an operation unit closely contacts an upper part of a main body when the operation unit closes an exhaust port to close the exhaust port.

The fifth purpose of the detailed description is to provide a cooking top configured to enable visual checking of a heating unit operational state or a heat intensity when an air curtain device is disposed higher than the heating unit at an upper part of a main body.

To achieve the first purpose of this specification, this disclosure provides a cooking top which may include: a main body including a heating unit; and an air curtain device configured to generate an air curtain flow so as to block a diffusion of a heating unit air flow generated by the heating unit, wherein the air curtain device includes: an intake port formed at the main body; an exhaust port extending along an upper edge part of the main body; a drive unit installed inside a flow guide extending from the intake port to the exhaust port and configured to generate a flow; and an operation unit rotatably mounted at the main body to open/close the exhaust port and configured to operate the drive unit when rotating to open the exhaust port by an operation so as to generate the air curtain flow when the exhaust port is opened.

The main body may include an interface unit installed at a front part of the main body and configured to operate the heating unit; and the exhaust port may be formed between the heating unit and the interface unit so as to prevent the heating unit air flow from diffusing in a direction toward the front part of the main body.

The main body may include a connection pin fixed at the main body and extending in a direction parallel to an extension direction of the operation unit; the operation unit may include a hinge part protruding from a back surface of the operation unit to receive the connection pin; and the operation unit may rotate by using the connection pin as an axis to open or close the exhaust port.

To achieve the second purpose of this specification, this disclosure provides a cooking top including: a main body including a heating unit; and an air curtain device configured to generate an air curtain flow so as to block a diffusion of a heating unit air flow generated by the heating unit, wherein the air curtain device includes: an intake port formed at the main body; an exhaust port extending along an upper edge part of the main body; a drive unit installed inside a flow guide extending from the intake port to the exhaust port and configured to generate a flow; an operation unit rotatably mounted at the main body to open/close the exhaust port and configured to operate the drive unit when rotating to open the exhaust port by an operation so as to generate the air curtain flow when the exhaust port is opened; and a drive control unit configured to transmit an operation signal to operate the drive unit when the exhaust port is opened.

The drive control unit may include an optical switch installed inside the exhaust port to detect a change in light by the opening of the exhaust port and transmit the operation signal.

The drive control unit may include a push switch installed at the main body to be pressed by the operation unit when the operation unit is located to open the exhaust port and transmit the operation signal.

To achieve the third purpose of this specification, this disclosure provides a cooking top which may include: a main body including a heating unit; and an air curtain device configured to generate an air curtain flow so as to block a diffusion of a heating unit air flow generated by the heating unit, wherein the air curtain device includes: an intake port formed at the main body; an exhaust port extending along an upper edge part of the main body; a drive unit installed inside a flow guide extending from the intake port to the exhaust port and configured to generate a flow; and an operation unit rotatably mounted at the main body to open/close the exhaust port and configured to operate the drive unit when rotating to open the exhaust port by an operation so as to generate the air curtain flow when the exhaust port is opened, and wherein the operation unit may include a guide part formed at a back surface of the operation unit to guide forming the air curtain flow in a predetermined form.

The operation unit may include a stopper part supported by the main body to be fixed at a predetermined angle when the exhaust port is opened.

The guide part formed at the back surface of the operation unit may guide forming the air curtain flow at a predetermined angle; and the stopper part supported by the main body to be fixed at the predetermined angle when the exhaust port is opened, wherein the stopper part may protrude from a back surface of the operation unit and may be installed at a position contacting the push switch when the exhaust port is opened.

To achieve the fourth purpose of this specification, this disclosure provides a cooking top may include: a main body including a heating unit; and an air curtain device configured to generate an air curtain flow so as to block a diffusion of a heating unit air flow generated by the heating unit, wherein the air curtain device includes: an intake port formed at the main body; an exhaust port extending along an upper edge part of the main body; a drive unit installed inside a flow guide extending from the intake port to the exhaust port and configured to generate a flow; and an operation unit rotatably mounted at the main body to open/close the exhaust port and configured to operate the drive unit when rotating to open the exhaust port by an operation so as to generate the air curtain flow when the exhaust port is opened, wherein the operation unit may include a sealing part configured to closely contact the main body when the exhaust port is closed to prevent foreign matter from entering from the outside of the main body into the inside.

The sealing part or the main body that the sealing part contacts closely may be formed of a magnetic material to allow the sealing part and the main body to contact each other closely by magnetic force.

To achieve the fifth purpose of this specification, the heating unit may be installed at a position where an upper part of the main body is recessed so as to be disposed lower than the exhaust port; and the interface unit may include a display configured to vary and output an area of a displayed image according to a heat intensity of the heating unit.

Meanwhile, the drive unit may include a cross flow fan installed at a lower part of the exhaust port and rotating by using a direction parallel to an extension direction of the operation unit as an axis to generate a flow.

According to the present disclosure constituted by the solution means described above, there are the following effects.

First, according to the present disclosure, an operation unit serves as a cover for closing an exhaust port where an air curtain flow is formed, so that the entry of foreign matter may be blocked and the reliable driving of the air curtain device for forming an air curtain flow may be possible. And, the opening of the exhaust port and the driving of the drive unit may be configured to be operated by the operation unit, so that the operation for operating the air curtain flow may be performed easily.

In addition, as the air curtain device may be located at the upper end edge of the interface unit for controlling whether to operate a heating unit and adjusting a heat intensity, it is possible to effectively prevent smells or smoke caused by the heating unit from diffusing to the interface unit which is a space where a user mainly stays. In addition, since the operation means of the heating unit and the operation means of the air curtain flow are located close to each other, it is convenient to perform an operation as needed while cooking.

Furthermore, since the operation of the operation unit is performed by rotating about the connection pin as an axis, the exhaust port is opened and closed and the drive unit is turned on/off only by pressing the side distant from the rotation shaft of the operation unit. Thereby, while the air curtain flow is selectively operated during cooking, the operation itself may be simplified.

Secondly, according to the present disclosure, since the opening of the exhaust port and the operation of the drive unit are mutually linked, it is possible to open the exhaust port and activate the air curtain flow simultaneously by operating the operation unit once.

Specifically, as an optical switch may be provided inside the exhaust port, the drive unit may be activated when the exhaust port is opened and the drive unit may be deactivated when the exhaust port is closed. Or, as a push switch may be provided at a portion where the operation unit and the main body contact each other, when the operation unit is located at a position for opening the exhaust port, the drive unit may operate and when the operation unit closes the exhaust port, the drive unit may stop. Therefore, since no separate drive unit operation is required, simple operation characteristics may be realized.

Thirdly, according to the present disclosure, as the air curtain flow is guided by the back surface of the operation unit, it may be smoothly formed in a desired shape according to the shape of the guide part, and energy loss due to friction, or the like, may be reduced.

Furthermore, as a stopper part for fixing the angle of the guide part may be provided with the exhaust port opened, it is possible to help forming the air curtain flow constantly.

In addition, as the stopper part is configured such that the protruding height or the like is variable, the angle at which the guide part is fixed may be varied and the air curtain flow may be adjusted to face an exhaust device such as a hood or the like provided at the top part of the cooking top.

Fourth, according to the present disclosure, since a sealing part may be provided such that the operation unit and the main body contact each other to close the exhaust port, food and foreign matter may be prevented from entering into the exhaust port when the air curtain function is not operated.

Specifically, as the sealing part is coupled to the main body by magnetic force, they are pressed to each other and contact each other closely, so that effective sealing may be provided. In addition, since the sealing part and the main body are separated from each other by more than a predetermined magnitude of force that pushes the opposite side of the side having the sealing part, a user may perform opening and closing operations by an operation of applying a prescribed magnitude of force.

Fifth, according to the present disclosure, when the heating unit is positioned below the exhaust port, as the state of the heating unit is displayed on the display of the front part, a user may check the heating unit operation state and a heat intensity through the display on the front part. Therefore, according to the present disclosure, even if a structure is provided including the operation unit at the upper end of the front part or a structure including the heating unit recessed downwardly, it is easy to check the state of the heating unit.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cooking top comprising:

a main body including a heating unit; and an air curtain device that generates an air curtain flow that blocks diffusion of air flow generated by the heating unit, wherein the air curtain device includes:

an intake port formed at the main body;

an exhaust port that extends laterally along an upper portion of the main body;

a flow guide that extends from the intake port to the exhaust port;

a drive unit installed inside the flow guide to generate airflow; and an airflow control device rotatably mounted at the main body to open and close the exhaust port and configured to operate the drive unit when the airflow control device is rotated to open the exhaust port so as to generate the air curtain flow, wherein the main body includes an interface unit installed at a front part of the main body and having controls to operate the heating unit; and the exhaust port is provided between the heating unit and the interface unit such that the air curtain flow from the exhaust port prevents the heating unit air flow from diffusing in a direction toward the front part of the main body.

2. The cooking top of claim 1, wherein the main body includes a connection pin fixed at the main body and extending in a direction parallel to a direction in which the airflow control device extends across the main body, the airflow control device includes a hinge part that protrudes from a back surface of the airflow control device to receive the connection pin, and wherein the connection pin forms an axis about which the airflow control device rotates to open or close the exhaust port.

3. The cooking top of claim 1, wherein the heating unit is installed at a position where an upper part of the main body is recessed so as to be disposed lower than the exhaust port, and the interface unit includes a display configured to display an indicator in which an area of the indicator varies according to a heat intensity of the heating unit.

4. A cooking top, comprising:

a main body including a heating unit; and an air curtain device that generates an air curtain flow that blocks diffusion of air flow generated by the heating unit, wherein the air curtain device includes:

an intake port formed at the main body;

an exhaust port that extends laterally along an upper portion of the main body;

a flow guide that extends from the intake port to the exhaust port;

a drive unit installed inside the flow guide to generate airflow; and an airflow control device rotatably mounted at the main body to open and close the exhaust port and configured to operate the drive unit when the airflow control device is rotated to open the exhaust port so as to generate the air curtain flow, wherein the air curtain device further includes a drive control unit that transmits an operation signal to operate the drive unit when the exhaust port is opened.

5. The cooking top of claim 4, wherein the drive control unit includes an optical switch installed inside the exhaust port to detect a change in light when the exhaust port is opened and the drive control unit transmits the operation signal based on the detected change in light.

6. The cooking top of claim 4, wherein the drive control unit includes a push switch installed at the main body and positioned to be pressed by the airflow control device when the airflow control device is rotated to open the exhaust port and the drive control unit transmits the operation signal based on a state of the push switch.

7. The cooking top of claim 6, wherein the airflow control device includes:

a guide part formed at a back surface of the airflow control device to guide forming the air curtain flow at a predetermined angle; and a stopper part supported by the main body to be fixed at a predetermined angle when the exhaust port is opened, wherein the stopper part protrudes from a back surface of the airflow control device and is installed at a position to contact the push switch when the exhaust port is opened.

8. A cooking top, comprising:

a main body including a heating unit; and an air curtain device that generates an air curtain flow that blocks diffusion of air flow generated by the heating unit, wherein the air curtain device includes:

an intake port formed at the main body;

an exhaust port that extends laterally along an upper portion of the main body;

a flow guide that extends from the intake port to the exhaust port;

a drive unit installed inside the flow guide to generate airflow; and an airflow control device rotatably mounted at the main body to open and close the exhaust port and configured to operate the drive unit when the airflow control device is rotated to open the exhaust port so as to generate the air curtain flow, wherein the airflow control device includes a guide part formed at a back surface of the airflow control device to guide the air curtain flow to have a predetermined form.

9. The cooking top of claim 8, wherein the airflow control device includes a stopper part provided on the back surface of the airflow control device and configured to be supported by the main body to fix the airflow control device at a predetermined angle when the exhaust port is opened.

10. A cooking top, comprising:

a main body including a heating unit; and an air curtain device that generates an air curtain flow that blocks diffusion of air flow generated by the heating unit, wherein the air curtain device includes:

an intake port formed at the main body;

an exhaust port that extends laterally along an upper portion of the main body;

a flow guide that extends from the intake port to the exhaust port;

a drive unit installed inside the flow guide to generate airflow; and an airflow control device rotatably mounted at the main body to open and close the exhaust port and configured to operate the drive unit when the airflow control device is rotated to open the exhaust port so as to generate the air curtain flow, wherein the airflow control device includes a sealing part that contacts the main body when the exhaust port is closed to prevent foreign matter from entering the main body through the exhaust port.

11. The cooking top of claim 10, wherein at least one of the sealing part or the main body where the sealing part contacts is formed of a magnetic material to allow the sealing part and the main body to contact each other by magnetic force.

12. A cooking top, comprising:

a main body including a heating unit; and an air curtain device that generates an air curtain flow that blocks diffusion of air flow generated by the heating unit, wherein the air curtain device includes:

an intake port formed at the main body;

an exhaust port that extends laterally along an upper portion of the main body;

a flow guide that extends from the intake port to the exhaust port;

a drive unit installed inside the flow guide to generate airflow; and an airflow control device rotatably mounted at the main body to open and close the exhaust port and configured to operate the drive unit when the airflow control device is rotated to open the exhaust port so as to generate the air curtain flow, wherein the drive unit includes a cross flow fan installed at a lower part of the exhaust port and configured to rotate about an axis that is parallel to a lengthwise direction of the airflow control device.

13. A cooking top comprising:

a main body including a heating unit; and an air curtain device that generates an air curtain flow that blocks diffusion of air flow generated by the heating unit, wherein the air curtain device includes:

an intake port formed at the main body;

an exhaust port that extends laterally along an upper portion of the main body;

a flow guide that extends from the intake port to the exhaust port;

a drive unit installed inside the flow guide to generate airflow; and an airflow control device rotatably mounted at the main body to open and close the exhaust port and configured to operate the drive unit when the airflow control device is rotated to open the exhaust port so as to generate the air curtain flow, wherein the airflow control device is mounted to the main body such that an upper end contacts a top surface of the main body in a closed state, a central region is rotatably coupled to the main body, and a bottom end protrudes away from the main body in the closed state, the air control device being configured to rotate vertically about the central region.

14. The cooking top of claim 13, wherein the airflow control device has a prescribed width that extends laterally across a front surface of the main body to correspond to a width of the exhaust port.

15. The cooking top of claim 14, wherein the upper end of the airflow control device contacts a first side of the exhaust port to form a seal in the closed state, and the central region of the airflow control device contacts a second side of the exhaust port such that the back surface of the airflow control device covers the exhaust port in the closed state.

16. The cooking top of claim 13, wherein the airflow control device is configured such that when the bottom end of the airflow control device is pressed, the airflow control device rotates vertically about the central region to open the exhaust port.

17. The cooking top of claim 16, wherein a back surface of the upper end of the airflow control device has a prescribed shape and position in the open state to form a shape of the air curtain flow to flow vertically at the front part of the main body.

18. The cooking top of claim 13, wherein the airflow control device has a plate shape that extends laterally along a width of the main body to cover the exhaust port.

19. A cooking top comprising:

a main body including a heating unit on a top surface;

an intake port formed at a front surface of the main body;

an exhaust port formed at the top surface of the main body between the heating unit and the front surface;

an air flow channel formed in the main body that extends from the intake port and the exhaust port;

a fan provided in the air flow channel to generate airflow for creating a vertical airflow having a prescribed shape; and an airflow control device rotatably mounted on the front surface of the main body and configured to cover the exhaust port, wherein the airflow control device is configured to close the exhaust port when rotated in a first direction and to open the exhaust port when rotated in a second direction opposite the first direction to generate the vertical airflow from the exhaust port, the vertical airflow forming an airflow curtain that provides a barrier between the front surface of the main body and the heating unit on the top surface, wherein the main body includes an interface unit installed at a front part of the main body and having controls to operate the heating unit; and the exhaust port is provided between the heating unit and the interface unit such that the air curtain flow from the exhaust port prevents the heating unit air flow from diffusing in a direction toward the front part of the main body.

* * * * *